US012808624B2

(12) United States Patent
Chu et al.

(10) Patent No.: US 12,808,624 B2
(45) Date of Patent: Nov. 24, 2026

(54) ARROW MAGAZINE STRUCTURE CAPABLE OF DETECTING NO-ARROW AND PREVENTING STRING-PULLING

(71) Applicant: MAN KUNG ENTERPRISE CO., LTD., Taichung (TW)

(72) Inventors: Fu-Hui Chu, Taichung (TW); Ching-Chi Hung, Taichung (TW)

(73) Assignee: MAN KUNG ENTERPRISE CO., LTD., Taichung (TW)

( * ) Notice: Subject to any disclaimer, the term of this patent is extended or adjusted under 35 U.S.C. 154(b) by 176 days.

(21) Appl. No.: 18/959,931

(22) Filed: Nov. 26, 2024

(65) Prior Publication Data

US 2025/0271234 A1 Aug. 28, 2025

(30) Foreign Application Priority Data

Feb. 23, 2024 (TW) ..... 113106690

(51) Int. Cl.
*F41B 5/12* (2006.01)

(52) U.S. Cl.
CPC ..... *F41B 5/126* (2013.01)

(58) Field of Classification Search
CPC ..... F41B 5/126
See application file for complete search history.

(56) References Cited

U.S. PATENT DOCUMENTS

2025/0198723 A1* 6/2025 Liu ..... F41B 5/126

FOREIGN PATENT DOCUMENTS

TW I774122 5/2022

* cited by examiner

*Primary Examiner* — Yingchuan Zhang
(74) *Attorney, Agent, or Firm* — Demian K. Jackson; Jackson IPG PLLC

(57) ABSTRACT

An arrow magazine structure capable of detecting no-arrow and preventing string-pulling is configured to accommodate a body. The body includes a holder, a bowstring spanning the holder. The arrow magazine structure contains an arrow magazine, a flexible abutting unit, and a retainer. The arrow magazine includes a fixing channel which has multiple arrows. The flexible abutting unit includes a presser and a resilient element. The retainer is accommodated on the holder and includes a first end and a second end. The retainer includes a biasing portion and a shoulder. A rotatable connection portion of the retainer and the holder is located between the shoulder and the biasing portion, the biasing portion is configured to press the contact portion downward so as to lift the shoulder upward, and the shoulder stops the bowstring being pulled, thus reminding a running out of the arrow of the arrow magazine.

13 Claims, 11 Drawing Sheets

ARROW MAGAZINE STRUCTURE CAPABLE OF DETECTING NO-ARROW AND PREVENTING STRING-PULLING

TECHNICAL FIELD

The present invention relates to an arrow magazine structure, and more particularly to the arrow magazine structure which is capable of detecting no-arrow and preventing string-pulling.

BACKGROUND

A crossbow is a bow with an elastic energy-storage mechanism mounted horizontally on a frame that is formed like a gun butt, and the crossbow is provided with a string hanging mechanism. A trigger is pulled to release when shooting. In addition to a conventional bow arm design, more and more compound crossbows using the mechanical principles of compound bows have appeared on the market in recent years. Compared with bows, crossbows usually have higher poundage and flatter external trajectories and can be installed with higher precise aiming equipment. Thus, it is suitable for accurate shooting at longer distances, and the shooting style is closer to that of firearms A conventional crossbow includes a bowstring, a body, a trigger device, multiple arrows, and other related devices and accessories. A quiver is attached to a user's waist and legs allowing for accommodation of the multiple arrows, thus allowing the user to take out the multiple arrows from the quiver, install the multiple arrows, and re-aim after each arrow is fixed, thus causing a troublesome operation.

A conventional arrow magazine capable of shooting arrows successively has been developed. For example, a safety protection device of a crossbow is disclosed in TW Patent No. I774122, wherein an arrow magazine is disposed on a top of a receiving portion of a body and is configured to accommodate multiple arrows, and a hooking arm abuts against a bottommost arrow of the multiple arrows to drop on a sliding rail, such that another bottommost arrow is dropped on the sliding rail after the bottommost arrow is shot, and a hooking section of the hooking arm falls downward by its gravity and is pushed by a spring to force an abutting section of the hooking arm. When a fixing channel is empty, the hooking section extends into the sliding rail. When a bowstring assembly is pulled to move opposite to a shooting direction, the hooking section of the hooking arm engages with the bowstring assembly of the body to remind the arrow magazine is empty.

However, the hooking section of the hooking arm of the conventional arrow magazine has to be provided with a recessed portion, thus reducing an abutting effect of the recessed portion against the body. When the arrow magazine is empty, the recessed portion of the hooking section is configured to hook the bowstring, thus limiting a pull of the bowstring. Thereby, the hooking arm has to be provided with a specific length to limit the bowstring being pulled flexibly and adjustably, thus causing damage to the recessed portion of the hooking arm and an unfitness of the top of the arrow magazine. Also, an extending direction of the recessed portion is limited to rotatably connect the hooking arm with a front end of the arrow magazine, thus having an inconvenience in a product structure design.

The present invention has arisen to mitigate and/or obviate the afore-described disadvantages.

SUMMARY

The primary aspect of the present invention is to provide an arrow magazine structure capable of detecting no-arrow and preventing string-pulling which contains the contact portion of the presser configured to abut against the multiple arrows and not broken by a pulling force of the bowstring, thus enhancing a durability and a service life.

Another aspect of the present invention is to provide an arrow magazine structure capable of detecting no-arrow and preventing string-pulling by which when the fixing channel of the arrow magazine is empty, the ruler bar stops the bowstring from being pulled, so the flexible abutting unit is movably mounted based on using requirements, thus providing diversified choices in a product structure design.

To obtain the above-mentioned aspects, an arrow magazine structure capable of detecting no-arrow and preventing string-pulling provided by the present invention is configured to accommodate a body, the body including a holder, a bowstring spanning the holder, the arrow magazine structure contains an arrow magazine, a flexible abutting unit, and a retainer.

The arrow magazine includes a fixing channel defined therein and communicating with the holder of the body, and the fixing channel has multiple arrows stacked together.

The flexible abutting unit includes a presser and a resilient element. One end of the presser is rotatably connected to the arrow magazine, and the presser has a contact portion formed on the other end thereof. The resilient element elastically forces the contact portion of the presser to abut against a topmost arrow of the fixing channel.

The retainer is accommodated on the holder, the retainer includes a first end and a second end opposite to the first end, and the retainer is rotatably connected to the holder by using the first end and the second end. The retainer includes a biasing portion formed on a top thereof adjacent to the first end, and a shoulder formed on the second end of the retainer. A rotatable connection portion of the retainer and the holder is located between the shoulder and the biasing portion, the biasing portion is configured to press the contact portion of the presser downward so as to lift the shoulder of the retainer upward, and the shoulder stops the bowstring being pulled, thus reminding a running out of the arrow of the arrow magazine.

DETAILED DESCRIPTION

Figure 1:
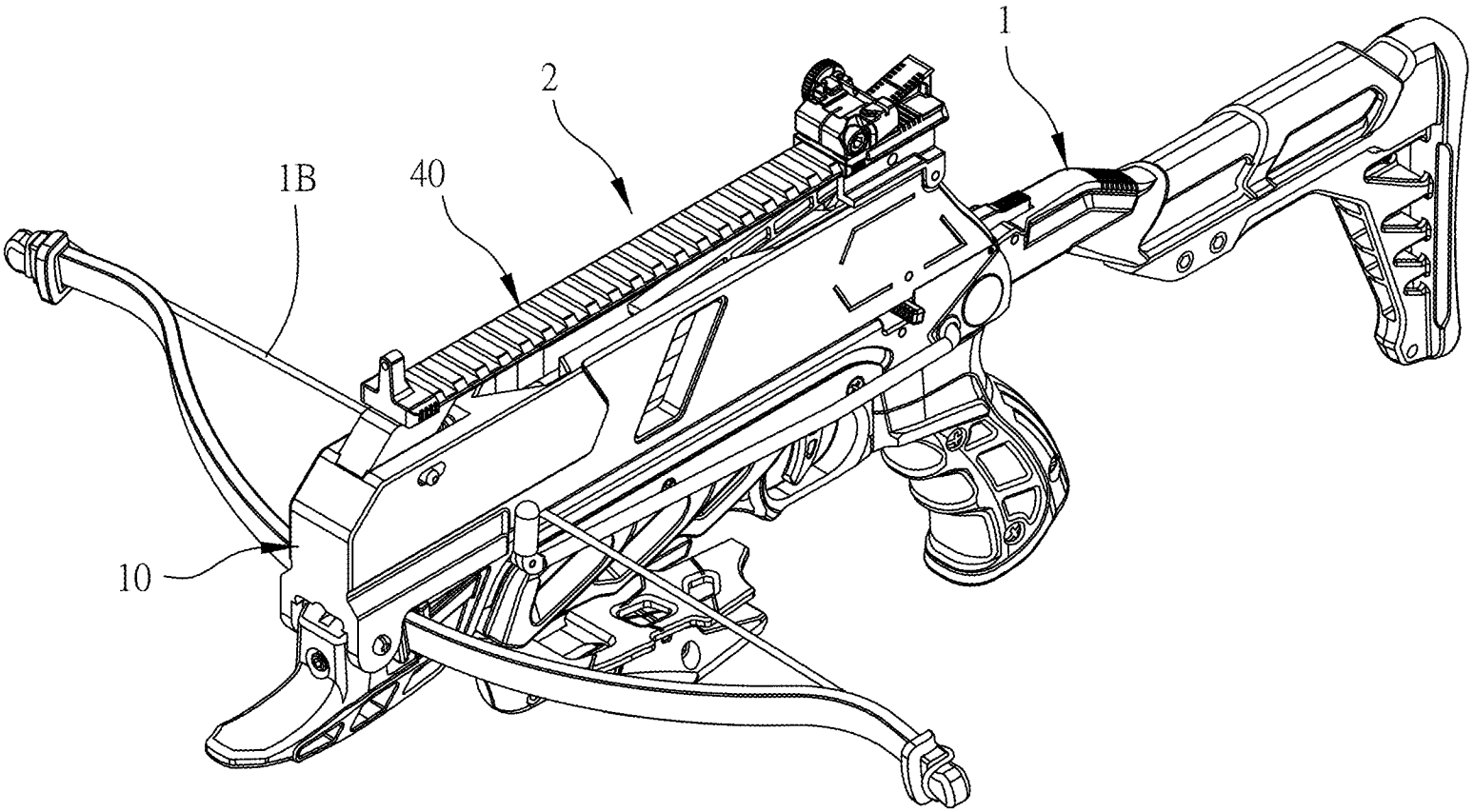
FIG. 1 is a perspective view showing the assembly of an arrow magazine structure fixed on a crossbow according to a preferred embodiment of the present invention.
Figure 2:
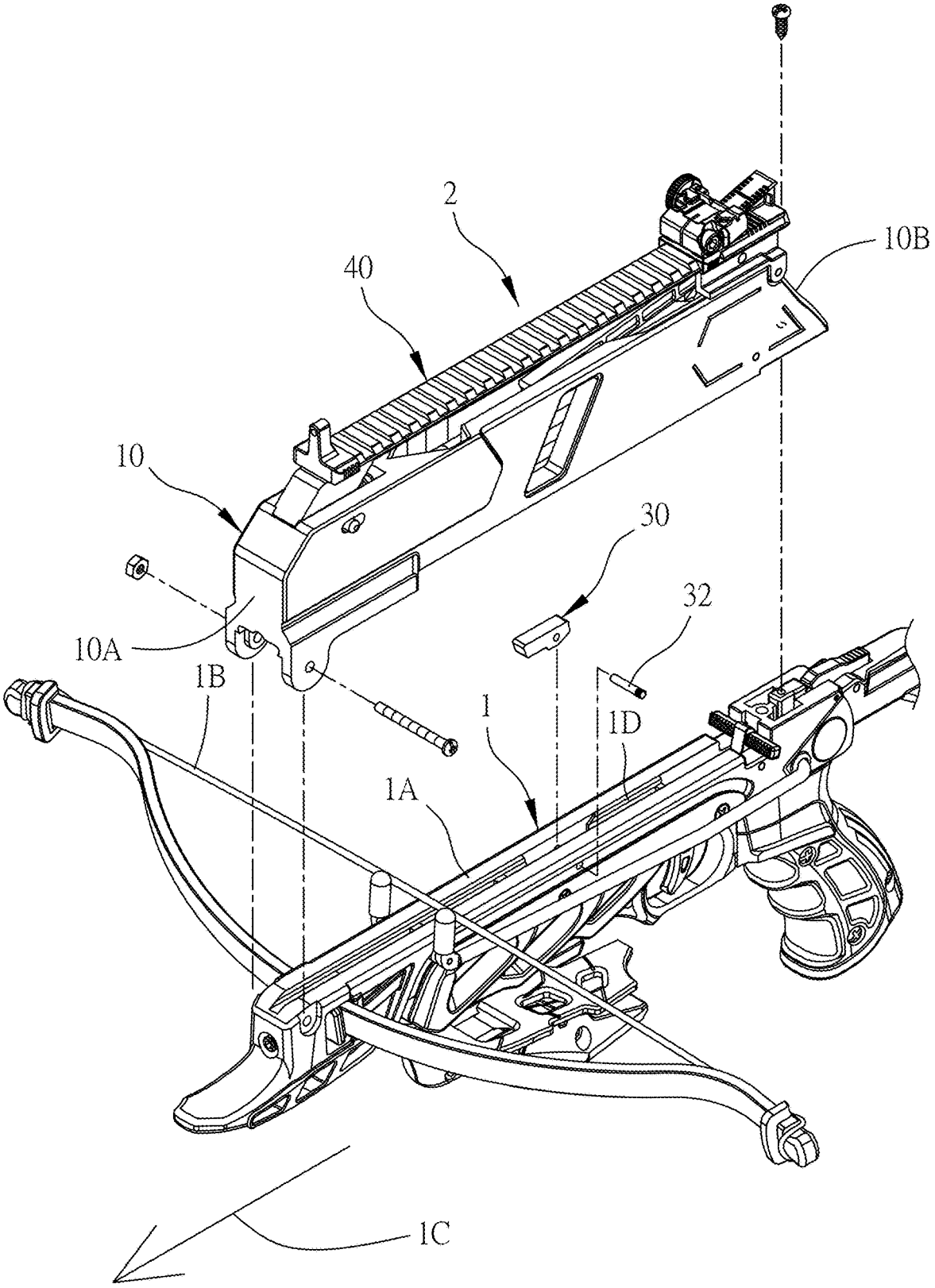
FIG. 2 is a perspective view showing the exploded components of the arrow magazine structure fixed on the crossbow according to the preferred embodiment of the present invention.
Figure 3:
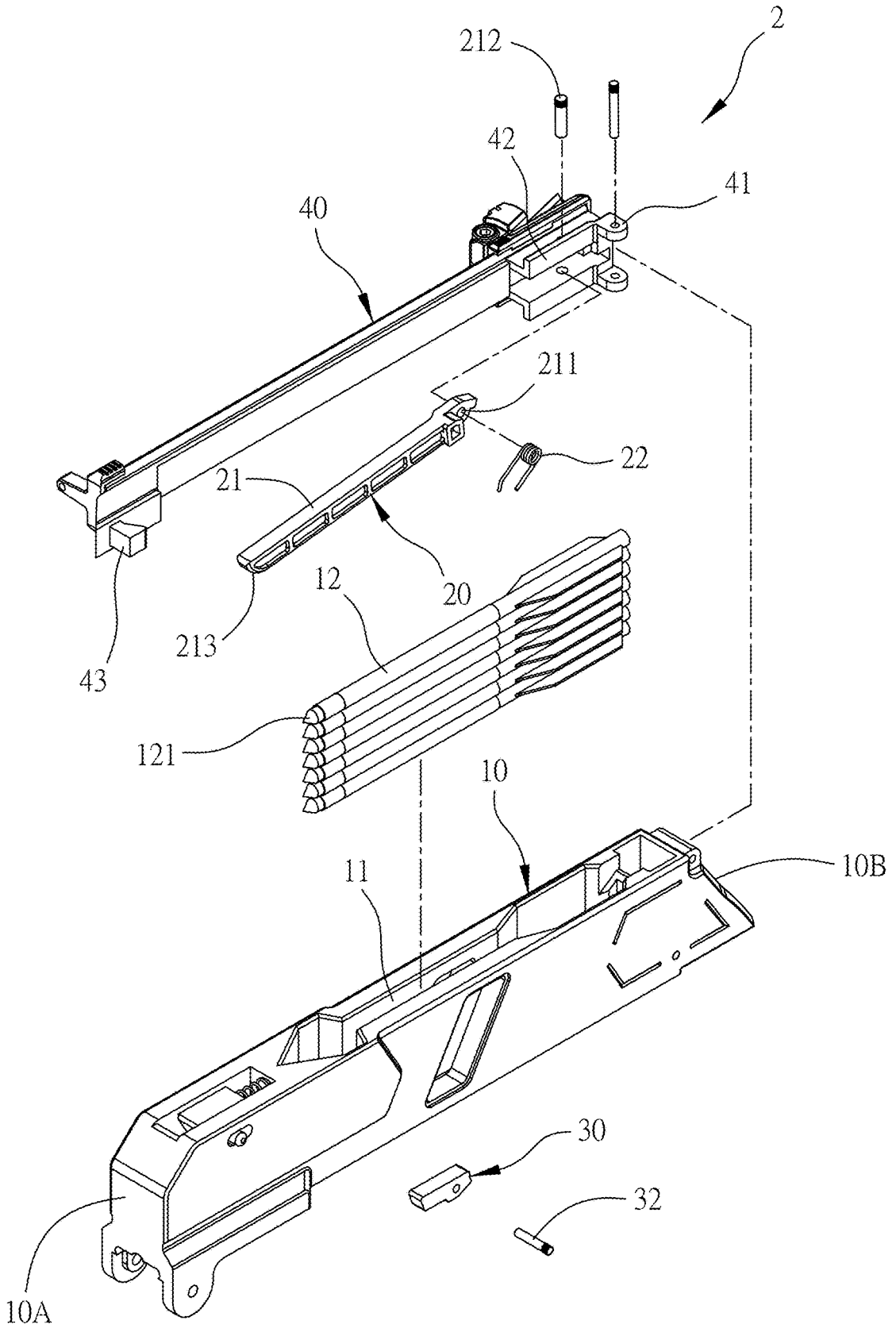
FIG. 3 is a perspective view showing the exploded components of the arrow magazine structure according to the preferred embodiment of the present invention.
Figure 4:
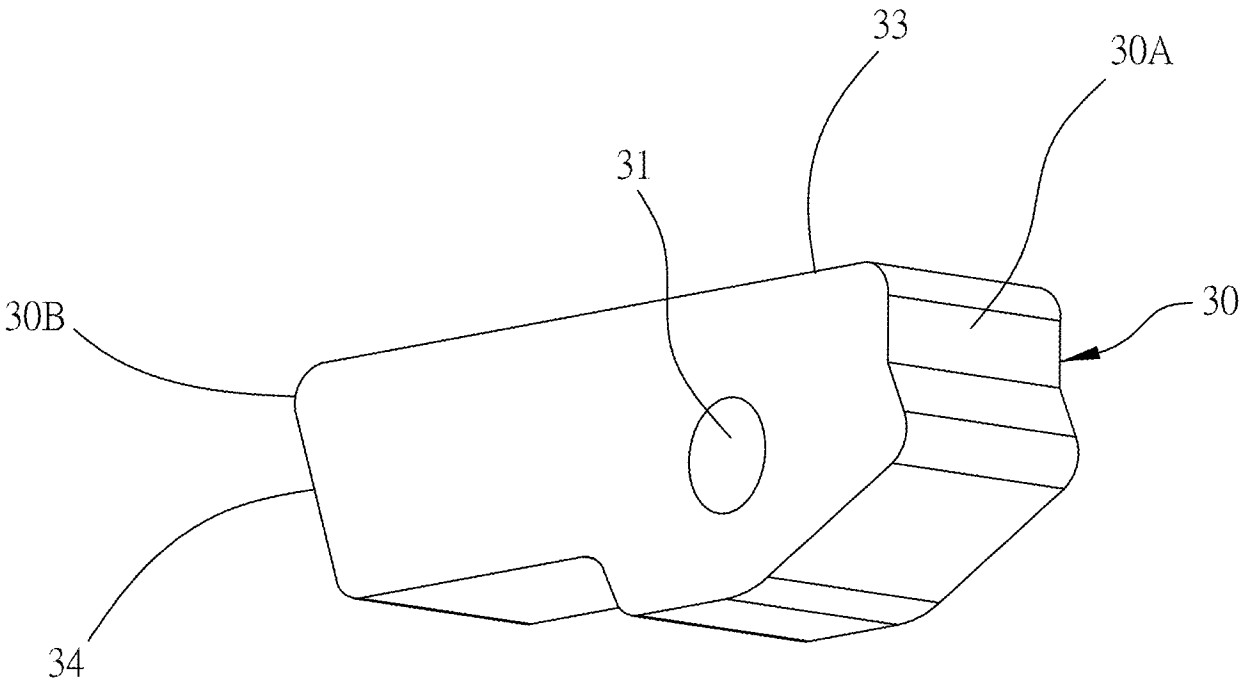
FIG. 4 is a perspective view showing the assembly of a retainer of the arrow magazine structure according to the preferred embodiment of the present invention.
Figure 5:
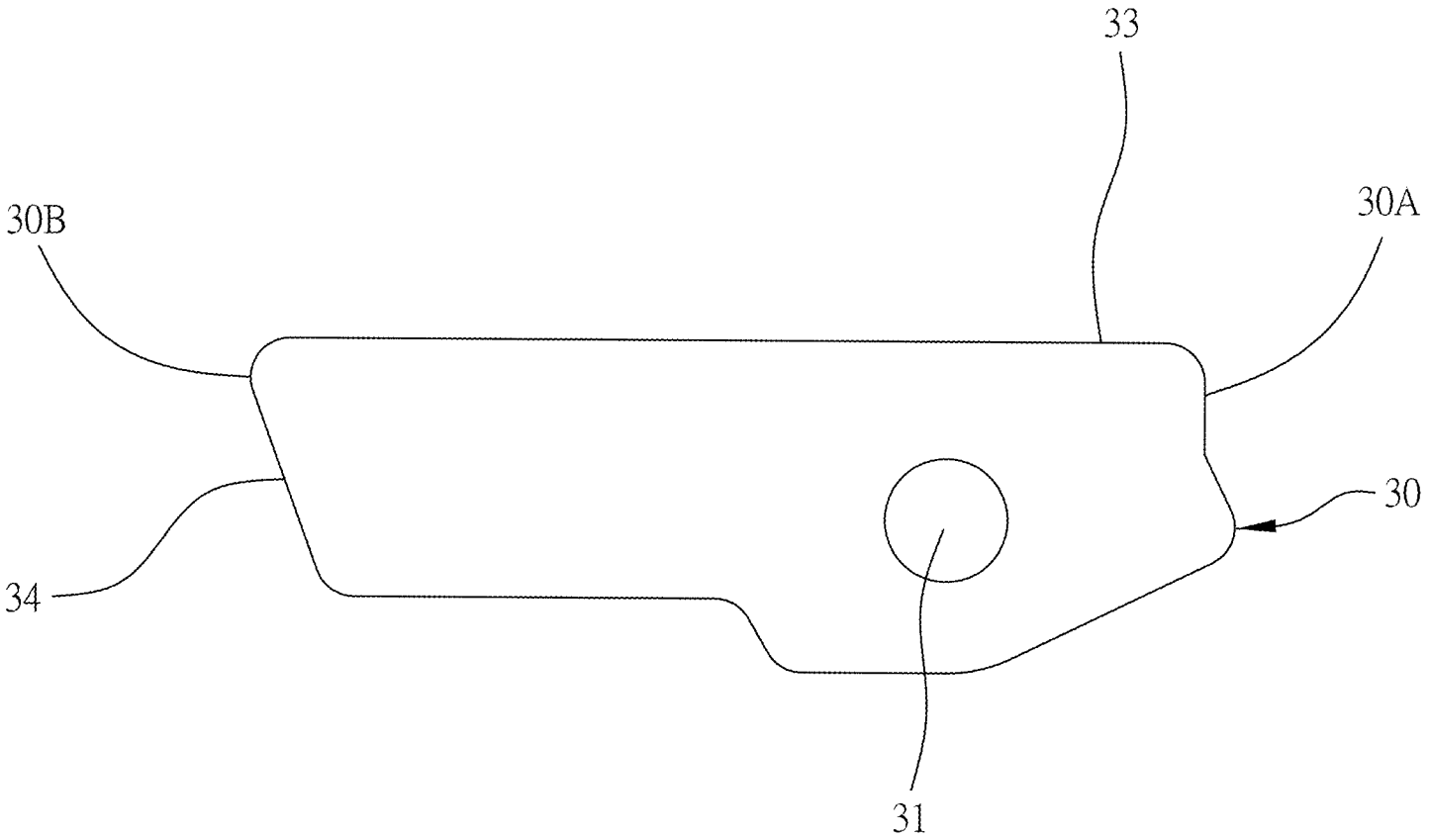
FIG. 5 is a side plan view showing the assembly of the retainer of the arrow magazine structure according to the preferred embodiment of the present invention.
Figure 6:
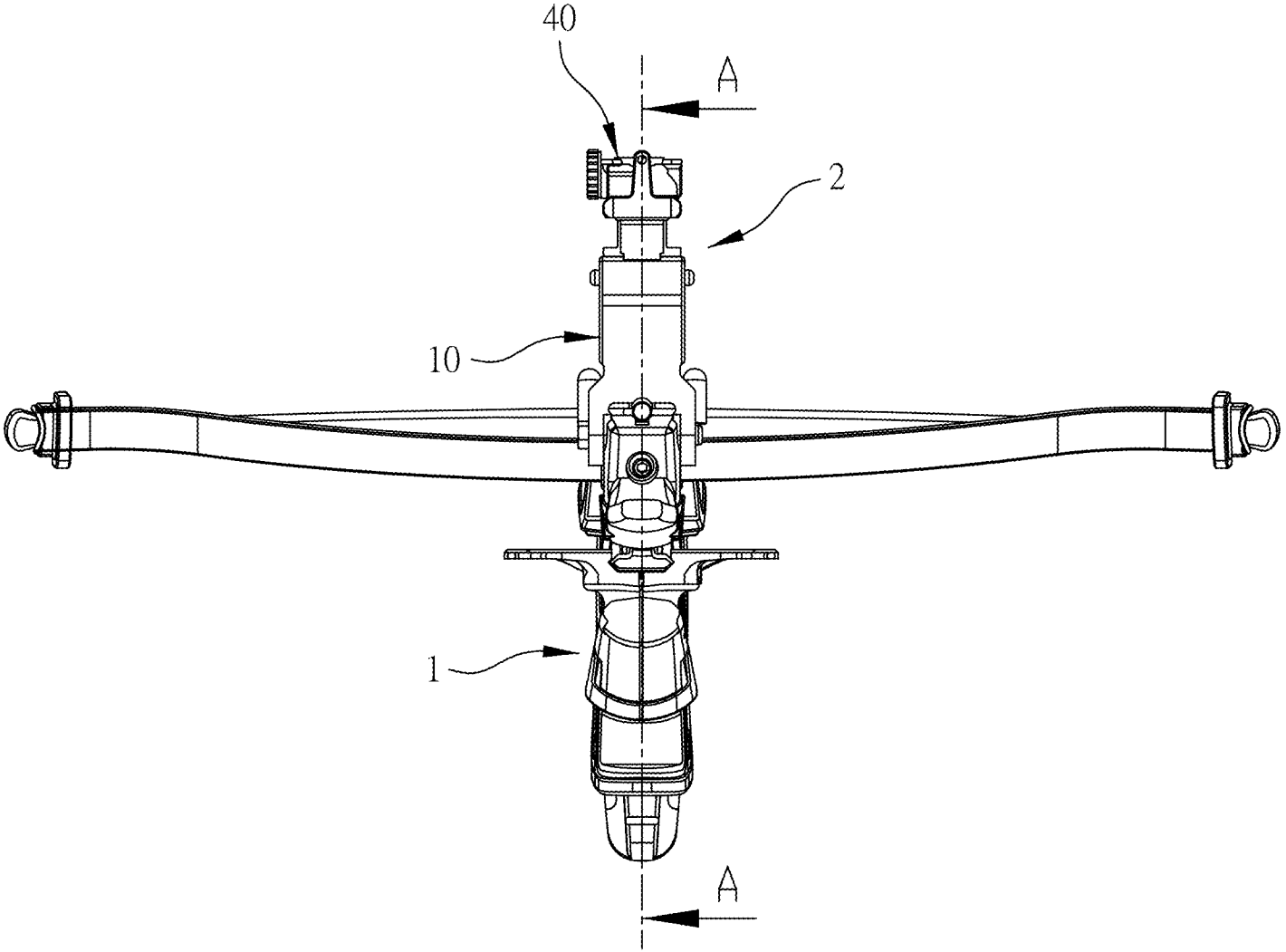
FIG. 6 is a top-plan view showing the assembly of the arrow magazine structure fixed on the crossbow according to the preferred embodiment of the present invention.
Figure 7:
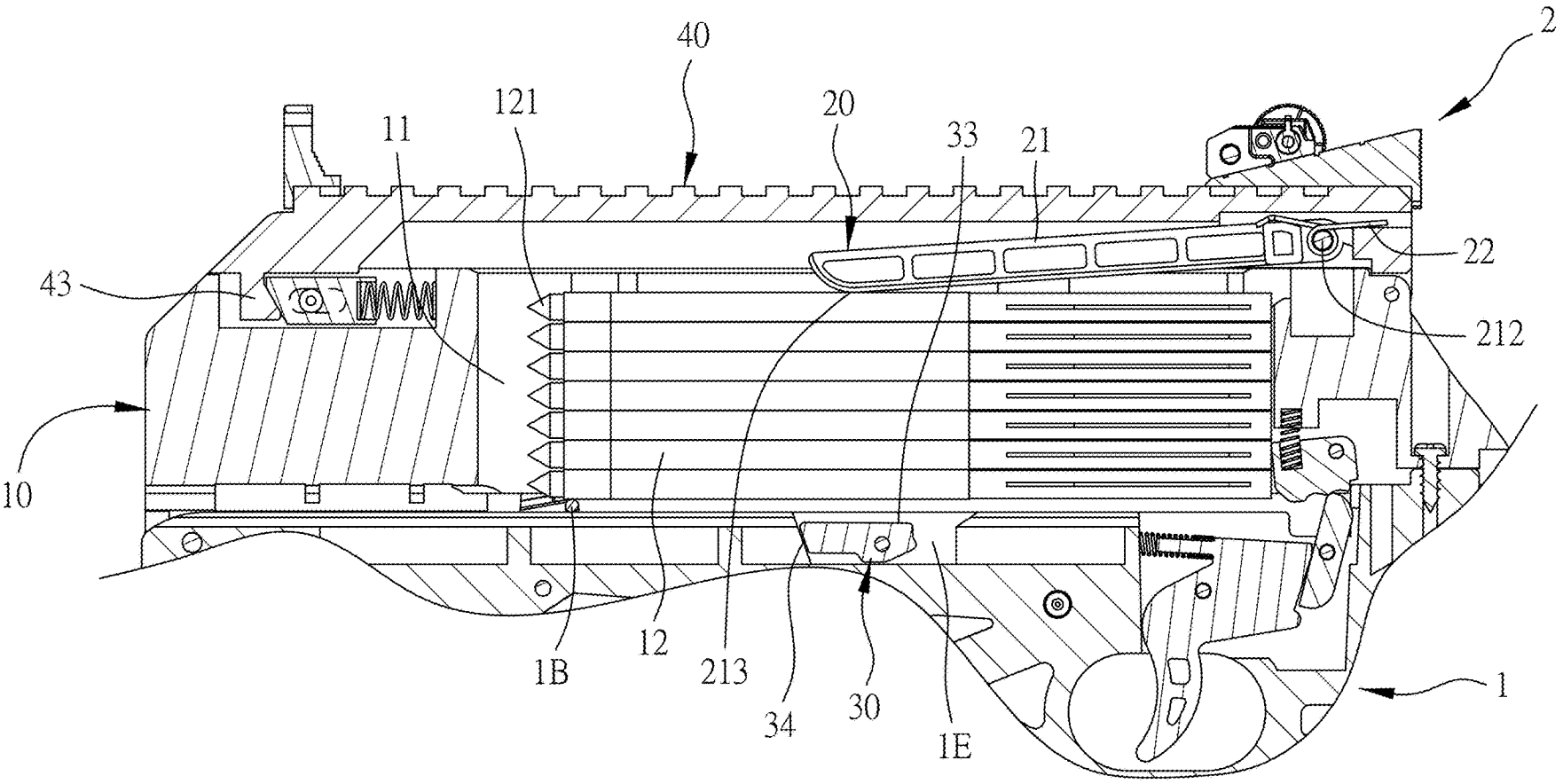
FIG. 7 is a cross-sectional view taken along the line A-A of FIG. 6.

With reference to FIGS. 1-7, an arrow magazine structure capable of detecting no-arrow and preventing string-pulling according to a preferred embodiment of the present invention is configured to accommodate a body 1 (in this embodiment, the body 1 is a crossbow), the body 1 includes a holder 1A, a bowstring 1B spanning the holder 1A, and a shooting direction 1C, a sliding rail 1D defined on the holder 1A, and a receiving groove 1E formed on a bottom of the sliding rail 1D. The arrow magazine structure 2 comprises an arrow magazine 10, a flexible abutting unit 20, a retainer 30, and a ruler bar 40.

The arrow magazine 10 is an elongated box and includes a front end 10A and a rear end 10B, the arrow magazine 10 includes a fixing channel 11 vertically passing through the arrow magazine 10 and communicating with the holder 1A of the body 1, wherein the fixing channel 11 has multiple arrows 12 stacked together, and a respective one arrow 12 has an arrowhead 121 facing the shooting direction 1C.

The flexible abutting unit 20 includes a presser 21 and a resilient element 22, wherein the presser 21 is elongated and has a connection orifice 211 defined on an end of the presser 21 and configured to receive a shaft 212 so that the presser 21 is rotatably connected on the body 10, and the presser 21 also has a contact portion 213 formed in an arc shape and on the other end thereof, the resilient element 22 is fixed on a rotatable connection portion of the presser 21 and the arrow magazine 10, the resilient element 22 elastically forces the contact portion 213 of the presser 21 to abut against a topmost arrow 12 of the fixing channel 11. In this embodiment, the presser 21 is rotatably connected on an outer wall of the fixing channel 11 of the arrow magazine 10, and the resilient element 22 is a torsion spring.

The retainer 30 is accommodated in the receiving groove 1E of the sliding rail 1D, and the retainer 30 includes a first end 30A and a second end 30B opposite to the first end 30A, wherein the retainer 30 is rotatably connected on the holder 1A by using the first end 30A and the second end 30B (In this embodiment, the retainer 30 includes a coupling orifice 31 defined on an eccentric portion thereof proximate to the first end 30A and configured to receive a post 32), wherein the retainer 30 includes a biasing portion 33 formed on a top thereof adjacent to the first end 30A, and a shoulder 34 being tilted and formed on the second end 30B of the retainer 30, wherein the rotatable connection portion of the retainer 30 and the holder 1A is located between the shoulder 34 and the biasing portion 33. In a normal state, the retainer 30 is forced by the respective one arrow 12 of the fixing channel 11 and contacts with an edge of the receiving groove 1E by mating with the shoulder 34 of the retainer 30 so that the top of the retainer 30 is received in the receiving groove 1E horizontally, the biasing portion 33 is configured to press the contact portion 213 of the presser 21 downward so as to lift the shoulder 34 of the retainer 30 upward, and the shoulder 34 stops the bowstring 1B being pulled, thus detecting and reminding a running out of the arrow 12 of the arrow magazine 10.

The ruler bar 40 is disposed on a top of the arrow magazine 10, and the ruler bar 40 includes a rotatable connection portion 41 and a connection seat 42 which are formed on an end of the ruler bar 40, an engagement portion 43 formed on the other end of the ruler bar 40, wherein the rotatable connection portion 41 is rotatably connected on the rear end 10B of the arrow magazine 10, the engagement portion 43 is movably engaged with the front end 10A of the arrow magazine 10. In this embodiment, the connection seat 42 is configured to fit with the presser 21, the connection orifice 211 is rotatably connected with the connection seat 42 of the ruler bar 49 by using the shaft 212, and the resilient element 22 is fitted on the shaft 212 to abut against between the presser 21 and the connection seat 42.

Figure 8:
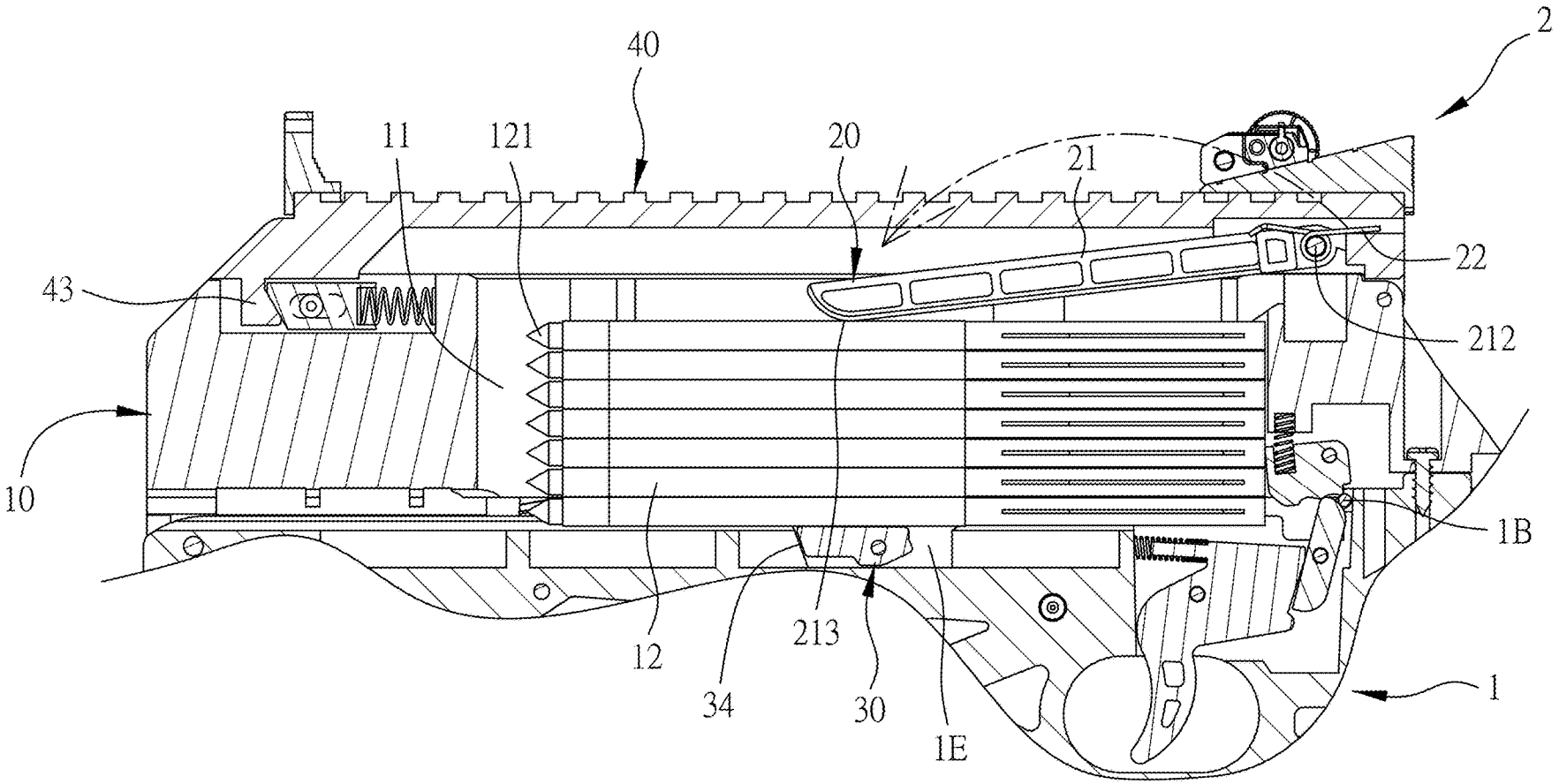
FIG. 8 is a cross-sectional view showing the operation of the arrow magazine structure according to the preferred embodiment of the present invention.

In operation, as shown in FIG. 8, the resilient element 22 pushes the contact portion 213 of the presser 21 downward to abut against the multiple arrows 12 of the fixing channel 11 so that a bottommost arrow 12 drops to the sliding rail 1D of the holder 1A of the body 1, and the bowstring 1B is pulled tightly to shoot the bottommost arrow 12 from the sliding rail 1D, thus shooting the multiple arrows 12 in turns to rapidly draw and fix the multiple arrows 12 successively.

Figure 9:
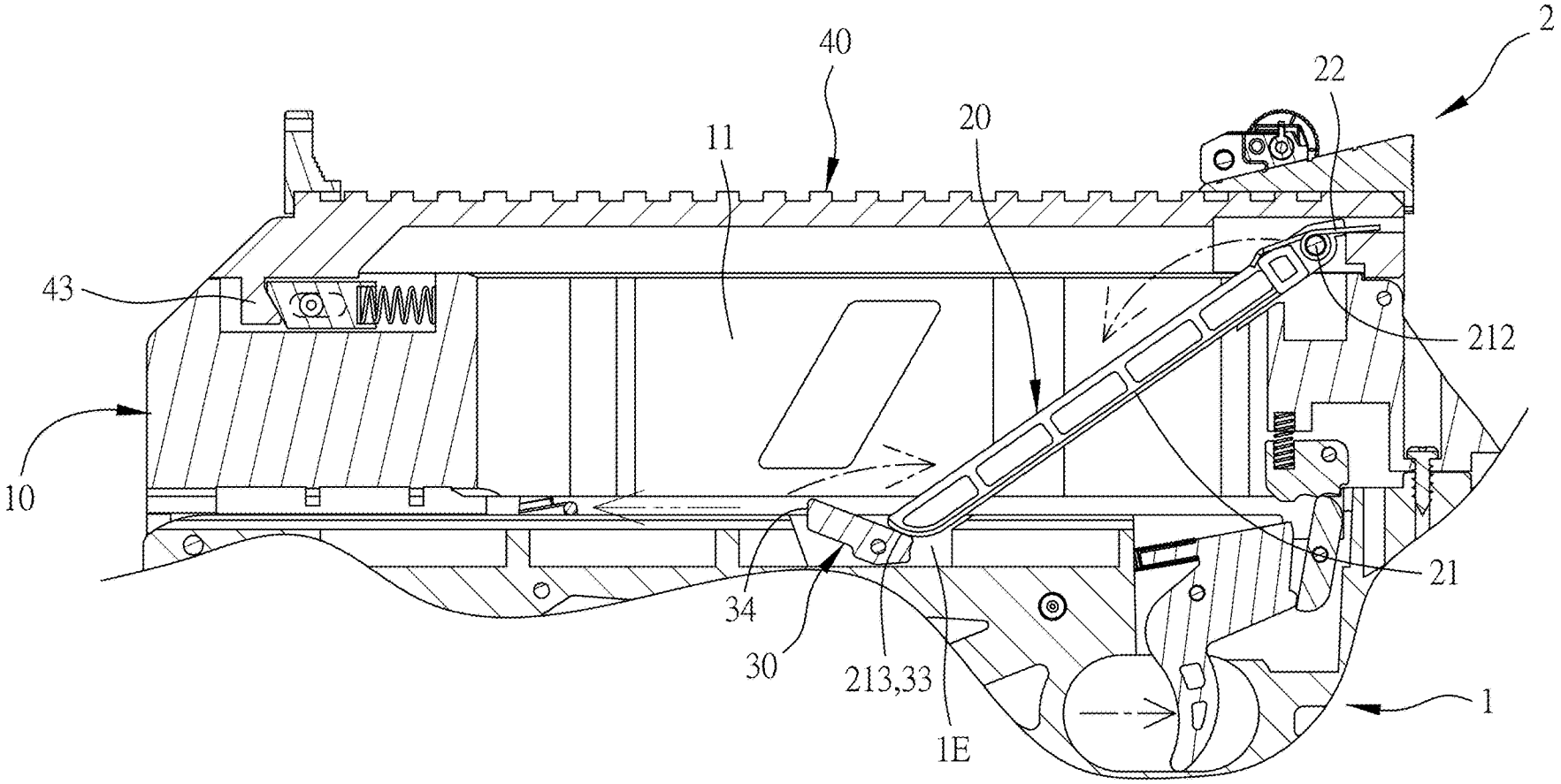
FIG. 9 is another cross-sectional view showing the operation of the arrow magazine structure according to the preferred embodiment of the present invention.
Figure 10:
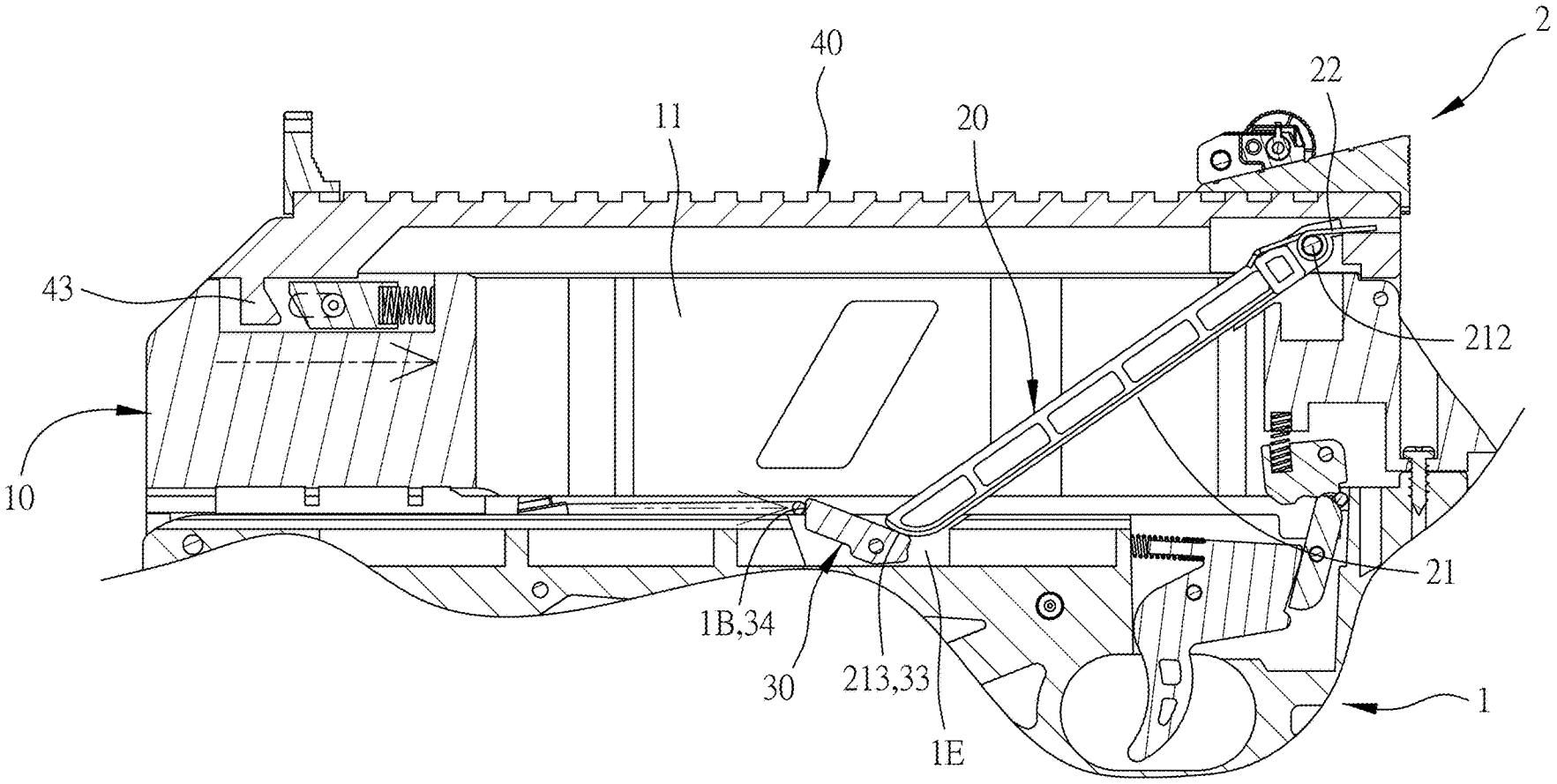
FIG. 10 is also another cross-sectional view showing the operation of the arrow magazine structure according to the preferred embodiment of the present invention.

After completely shooting the multiple arrows 12 of the arrow magazine 10 from the fixing channel 11, as shown in FIGS. 9 and 10, the biasing portion 33 presses the contact portion 213 of the presser 21 downward so as to lift the shoulder 34 of the retainer 30 upward, wherein when the bowstring 1B is pulled to move away from the shooting direction 1C, the shoulder 34 of the retainer 30 stops the bowstring 1B being pulled, thus detecting and reminding the running out of the arrow 12 of the fixing channel 11 of the arrow magazine 10. Accordingly, it is evitable that no-arrow in the arrow magazine 10 causes dry fire to damage the body 1 and related devices and components.

Figure 11:
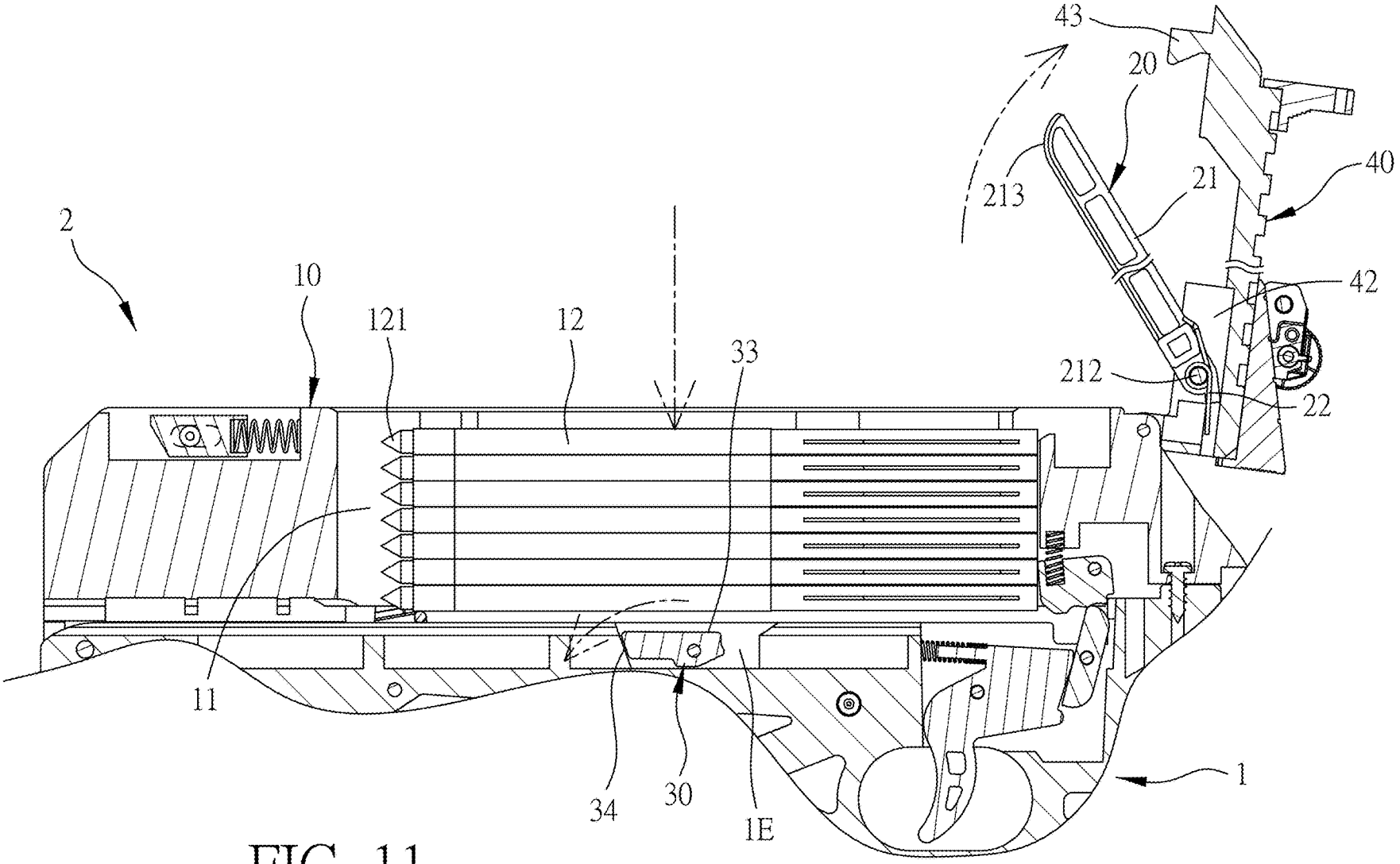
FIG. 11 is still another cross-sectional view showing the operation of the arrow magazine structure according to the preferred embodiment of the present invention.

When the fixing channel 11 of the arrow magazine 10 is empty, as shown in FIG. 11, the engagement portion 43 of the ruler bar 40 is disengaged from the front end 10A of the arrow magazine 10, the rotatable connection portion 41 of the ruler bar 40 is rotated upward and backward to actuate the presser 21 to rotate upward so as to remove the presser 21 from the fixing channel 11, hence more multiple arrows 12 are received in the fixing channel 11 and are stacked together, and the arrowhead 121 of the respective one arrow 12 faces the shooting direction 1C, then the ruler bar 30 is rotated downward to engage the biasing portion 33 with the front end 10A of the arrow magazine 10, and the contact portion 213 of the presser 21 downward abuts against the topmost arrow 12 of the fixing channel 11, thus accommodating and shooting the multiple arrows successively.

Accordingly, the arrow magazine structure of the present invention has advantages as follows:

1) The contact portion 213 of the presser 21 is configured to abut against the multiple arrows and is not broken by a pulling force of the bowstring 1B, thus enhancing durability and service life.
2) When the fixing channel 11 of the arrow magazine 10 is empty, the ruler bar 30 stops the bowstring 1B from being pulled, so the flexible abutting unit 20 is movably mounted based on using requirements, thus providing diversified choices in a product structure design.

While the first embodiments of the invention have been set forth for the purpose of disclosure, modifications of the disclosed embodiments of the invention as well as other embodiments thereof may occur to those skilled in the art.

The scope of the claims should not be limited by the first embodiments set forth in the examples, but should be given the broadest interpretation consistent with the description as a whole.

What is claimed is:

1. An arrow magazine structure capable of detecting no-arrow and preventing string-pulling configured to accommodate a body, the body including a holder, a bowstring spanning the holder, the arrow magazine structure comprising:

an arrow magazine including a fixing channel defined in the arrow magazine and communicating with the holder of the body, wherein the fixing channel has multiple arrows stacked together;

a flexible abutting unit including a presser and a resilient element, wherein one end of the presser is rotatably connected to the arrow magazine, and the presser has a contact portion formed on the other end thereof, wherein the resilient element elastically forces the contact portion of the presser to abut against a topmost arrow of the fixing channel; and a retainer accommodated on the holder, wherein the retainer includes a first end and a second end opposite to the first end, wherein the retainer is rotatably connected on the holder by using the first end and the second end, wherein the retainer includes a biasing portion formed on a top thereof adjacent to the first end, and a shoulder formed on the second end of the retainer, wherein a rotatable connection portion of the retainer and the holder is located between the shoulder and the biasing portion, the biasing portion is configured to press the contact portion of the presser downward so as to lift the shoulder of the retainer upward, and the shoulder stops the bowstring being pulled, thus reminding a running out of the arrow of the arrow magazine.

2. The arrow magazine structure as claimed in claim 1, wherein the holder includes a sliding rail defined thereon, and the holder includes a receiving groove formed on a bottom of the sliding rail, wherein the retainer is accommodated in the receiving groove of the sliding rail.

3. The arrow magazine structure as claimed in claim 2, wherein the retainer includes a coupling orifice defined on an eccentric portion thereof proximate to the first end and configured to receive a post; in a normal state, the retainer is forced by a respective one arrow of the fixing channel and contacts with an edge of the receiving groove by mating with the shoulder of the retainer so that the top of the retainer is received in the receiving groove horizontally.

4. The arrow magazine structure as claimed in claim 1, wherein the shoulder of the retainer is tilted.

5. The arrow magazine structure as claimed in claim 1, wherein the presser is elongated and has a connection orifice defined on an end thereof and configured to receive a shaft so that the presser is rotatably connected on the fixing channel of the body.

6. The arrow magazine structure as claimed in claim 1, wherein the contact portion is formed in an arc shape.

7. The arrow magazine structure as claimed in claim 1, wherein the resilient element is fixed on a rotatable connection portion of the presser and the arrow magazine, and the resilient element is a torsion spring.

8. The arrow magazine structure as claimed in claim 1 further comprises a ruler bar which is disposed on a top of the arrow magazine, wherein the ruler bar includes a rotatable connection portion and a connection seat which are formed on an end of the ruler bar, an engagement portion formed on the other end of the ruler bar, wherein the arrow magazine includes a front end and a rear end, the rotatable connection portion is rotatably connected on the rear end of the arrow magazine, and the engagement portion is movably engaged with the front end of the arrow magazine.

9. The arrow magazine structure as claimed in claim 8, wherein the connection seat is configured to fit with the presser, the presser has a connection orifice defined on an end thereof, wherein the connection orifice accommodates the shaft so as to rotatably connect the connection orifice with the connection seat of the ruler bar, and the resilient element is fitted on the shaft to abut against between the presser and the connection seat.

10. An arrow magazine structure capable of detecting no-arrow and preventing string-pulling configured to accommodate a body, the body including a holder, a bowstring spanning the holder, the arrow magazine structure comprising:

an arrow magazine including a fixing channel defined in the arrow magazine and communicating with the holder of the body, wherein the fixing channel has multiple arrows stacked together;

a flexible abutting unit including a presser and a resilient element, wherein one end of the presser is rotatably connected to the arrow magazine, and the presser has a contact portion formed on the other end thereof, wherein the resilient element elastically forces the contact portion of the presser to abut against a topmost arrow of the fixing channel; and a retainer accommodated on the holder, wherein the retainer includes a first end and a second end, wherein the retainer is rotatably connected on the holder, wherein the retainer includes a biasing portion formed on a top thereof adjacent to the first end, and a shoulder formed on the second end of the retainer, the biasing portion is configured to press the contact portion of the presser downward so as to lift the shoulder of the retainer upward, and the shoulder stops the bowstring being pulled, thus reminding a running out of the arrow of the arrow magazine.

11. The arrow magazine structure as claimed in claim 10, wherein the holder includes a sliding rail defined thereon, and the holder includes a receiving groove formed on a bottom of the sliding rail, wherein the retainer is accommodated in the receiving groove of the sliding rail.

12. The arrow magazine structure as claimed in claim 11, wherein the retainer includes a coupling orifice defined on an eccentric portion thereof proximate to the first end and configured to receive a post; in a normal state, the retainer is forced by a respective one arrow of the fixing channel and contacts with an edge of the receiving groove by mating with the shoulder of the retainer so that the top of the retainer is received in the receiving groove horizontally.

13. The arrow magazine structure as claimed in claim 10, wherein the resilient element is fixed on a rotatable connection portion of the presser and the arrow magazine, and the resilient element is a torsion spring.

* * * * *